US006848820B2

(12) United States Patent
Natsume

(10) Patent No.: US 6,848,820 B2
(45) Date of Patent: Feb. 1, 2005

(54) VEHICULAR LAMP EMPLOYING LED LIGHT SOURCES

(75) Inventor: Kazunori Natsume, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/379,810

(22) Filed: Mar. 6, 2003

(65) Prior Publication Data

US 2003/0174514 A1 Sep. 18, 2003

(30) Foreign Application Priority Data

Mar. 15, 2002 (JP) ..... P2002-072678

(51) Int. Cl.[7] ..... F21V 13/04; F21V 7/06
(52) U.S. Cl. ..... 362/545; 362/241; 362/247
(58) Field of Search ..... 362/240, 241, 362/245, 247, 297, 348, 544, 545, 346

(56) References Cited

U.S. PATENT DOCUMENTS 4,929,866 A * 5/1990 Murata et al. ..... 362/545
5,453,855 A 9/1995 Nakamura et al.
5,642,933 A * 7/1997 Hitora ..... 362/243
6,238,073 B1 * 5/2001 Ito et al. ..... 362/544

FOREIGN PATENT DOCUMENTS

JP 61-183004 U 11/1986
JP 63-22004 U 2/1988
JP 11-306810 11/1999

* cited by examiner

*Primary Examiner*—Alan Cariaso
(74) *Attorney, Agent, or Firm*—Sughrue Mion, PLLC

(57) ABSTRACT

A vehicular lamp employing a plurality of LED light sources and arranged to emit light using indirect illumination wherein the total light emittance in the front direction of the lamp is increased by more effectively using the light from the LED light sources. The LED light sources are arranged in a line in the vertical direction such that their direction of light emission is toward the rear of the lamp. The reflecting surface of the reflector is divided into right and left reflecting areas by a boundary line. With this arrangement, a large portion of the light from each LED light source contributes to the light reflected by the reflector. The reflecting areas are divided into a plurality of small reflecting surfaces, preferably two for each LED light source. Thus, it is possible to separately control the reflection of the light from each LED light source by the small reflecting surfaces on both sides of the LED light sources. When the lamp is observed from the front, the number of illuminated areas is greater than the number of LED light sources.

27 Claims, 10 Drawing Sheets

VEHICULAR LAMP EMPLOYING LED LIGHT SOURCES

CROSS-REFERENCE TO RELATED APPLICATIONS

Not applicable

STATEMENT REGARDING FEDERALLY SPONSORED RESEARCH OR DEVELOPMENT

Not applicable

REFERENCE TO SEQUENCE LISTING, A TABLE, OR A COMPUTER PROGRAM LISTING COMPACT DISK APPENDIX

Not applicable

BACKGROUND OF THE INVENTION

The present invention relates to a vehicular lamp employing a plurality of LED light sources, and more particularly to a vehicular lamp of a type which is configured so as to emit light using an indirect illumination technique.

Many vehicular lamps including a LED light source have been employed in recent years. For example, as disclosed in Japanese Patent No. 3,173,453 or Japanese Patent Laid-Open Publication No. 11-306810, a plurality of LED light sources are arranged in a line and mounted in such a manner so as not to be visible from the front of the lamp. The light output from the LED light sources is directed rearward toward the reflector, and the light from the LED light sources is reflected toward the front of the lamp by the reflector. This construction provides a soft illumination effect due to the use of indirect illumination.

However, in such a conventional vehicular lamp, since a common reflector is shared by a plurality of LED light sources arranged in a line, the reflection of light from each LED light source cannot be individually controlled. For this reason, the ratio of the total light output from the lamp, that is, the total light reflected in the direction toward the front face of the lamp, to the total light output from all the LEDs is small. As a result, there is a problem that the lamp is rather dim when observed from the front.

BRIEF SUMMARY OF THE INVENTION

In view of the foregoing problem, it is an object of the present invention to provide a vehicular lamp employing a plurality of LED light sources and utilizing an indirect illumination technique wherein the total light emitted in the direction toward the front face of the lamp is increased by more effectively using the light from the LED light sources.

In a vehicular lamp constructed according to the present invention, the light emitting direction of each of the LED light sources is determined and as the structure of the reflecting surface of the reflector is designed in such a manner as to achieve the aforementioned object.

More specifically, a vehicular lamp according to the present invention includes a plurality of LED light sources, a reflector for reflecting light from the LED light sources toward the front of the lamp, and a translucent cover provided at the lamp front side of the reflector. The LED light sources are arranged in a line with their light output being directed toward the rear of the lamp. The reflecting surface of the reflector is divided into two reflecting areas by a boundary line which is substantially parallel to the primary axis of the line of LED light sources, and each reflecting area is divided into a plurality of small reflecting surfaces, with two small reflecting surfaces being thereby provided for each LED light source.

The LEDs are not limited to any specific structure as long as they are arranged in a line with their output light beams directed toward the rear of the lamp. For example, structures such as a straight-line arrangement, a zigzag-line arrangement, or a curved-line arrangement can be employed. Moreover, the rear of the lamp need not be directly behind the lamp as some amount of deviation is acceptable.

The two reflecting areas may be configured so as to have the same size and the same shape, or they may have different sizes and different shapes, as long as they are divided by a boundary line which is generally parallel to the arrangement direction of the line of LED light sources.

The small two reflecting surfaces associated with each of the LED light sources may also be configured so as to have the same size and the same shape, or they may have different sizes and different shapes. In addition, the small reflecting surfaces each may be constituted by a single reflecting surface or a plurality of reflecting elements.

As described above, a vehicular lamp constructed according to the present invention is configured so that light from a plurality of LED light sources is reflected toward the front of the lamp by a reflector. The LED light sources are arranged in a line with their output light beams being directed toward the rear of the lamp, and the reflector is divided into two reflecting areas by a boundary line which is substantially parallel to the line along which the plurality of LED light sources are arranged. Therefore, a large part of the light emitted by each the LED light sources will strike the reflecting surface of the reflector and thus form part of the light reflected by the reflector. In addition, since each of these reflecting areas is divided into a plurality of small reflecting surfaces for each LED light source, the light from each LED light source can be appropriately controlled by the corresponding small reflecting surfaces, which are located on both sides of the LED light source. As a result, a large part of the light which is directed toward the rear of the lamp is utilized. Moreover, since each reflecting area is divided into a plurality of small reflecting surfaces, two for each LED light source, when the lamp is observed from the front, there are more illuminated areas than there are actual light sources.

Accordingly, the vehicular lamp of the invention, which employs a plurality of LED light sources and uses an indirect illumination technique, the amount of light emitted in the forward direction toward the front face of the lamp is increased by effectively using the light from each of the LED light sources. As a result, the overall appearance of the lamp is improved.

In the aforementioned structure, if the position of the boundary line between the two reflecting areas is determined such that the output light beam of each LED light source is substantially bisected, the reflecting areas on the two sides of the boundary line will be illuminated with substantially equal luminosity.

In addition, if in the aforementioned structure each small reflecting surface is constituted by a plurality of reflecting elements, the number of illuminated areas is further increased. Therefore, the appearance of the lamp can be further improved.

Further, in the aforementioned structure, if a cylindrical lens is provided to condense the light from the LEDs in a direction along the boundary line in the vicinity of the lamp rear side of each LED light source, most of the light from each light source will reach the small reflecting surfaces which correspond to that LED light source. As a result, the reflection of the light from each LED light source is carried out in such a manner that the light can be used effectively.

In a case where a plurality of LED light sources are arranged in a line with their output beams directed toward the rear of the lamp, for purposes of obtaining a good overall appearance of the lamp it is necessary to provide a cover member to cover the LED light sources on the front side of the LED light sources.

The cover member may be constituted by a translucent member having a U-shaped cross section in a direction perpendicular to the boundary line, and the cover may be mounted with both end faces directed toward the rear of the lamp. In this case, a part of the light reflected by the reflector enters the two end faces of the cover member and is guided to the front end portion of the cover member, thereby illuminating the cover member. Accordingly, when the lamp is lit, a plurality of pairs of the small reflecting surfaces which constitute the reflector are illuminated on both sides of the cover member, and in addition the cover member is illuminated at a position offset from the reflecting surface in the frontward direction. Therefore, it is possible to provide a lamp having a three-dimensional appearance when illuminated.

If the area in the vicinity of the boundary line on the reflecting surface of the reflector is constituted as pairs of vertically elongated reflecting areas for facilitating light entry to the cover member by reflecting light from LED light sources at both end faces of the cover member, the amount of the light entering the cover member is increased, thus illuminating the cover member even more brightly.

DETAILED DESCRIPTION OF THE INVENTION

A first preferred embodiment of a vehicular lamp constructed according to the present invention will be explained with reference to the accompanying drawings.

Figure 1:
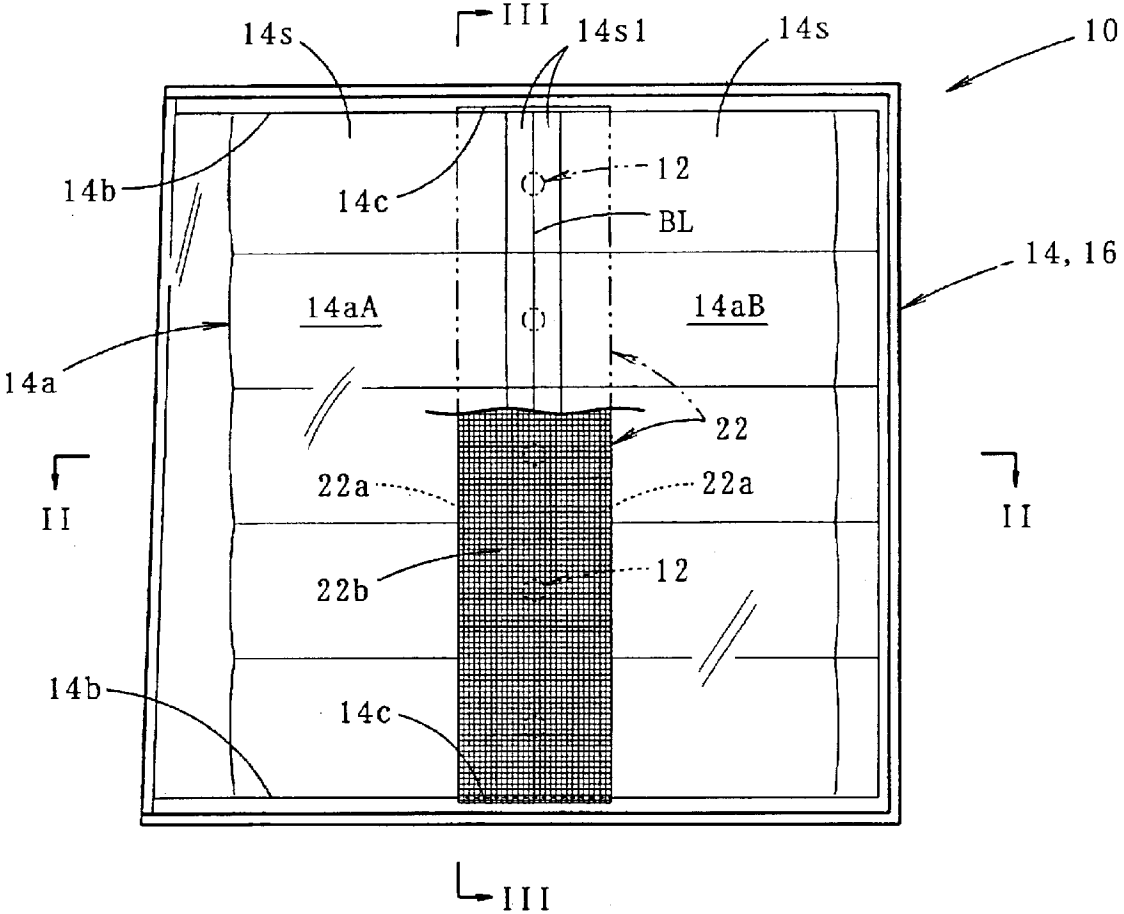
FIG. 1 is a front view of a vehicular lamp constructed according to a preferred embodiment of the invention.
Figure 2:
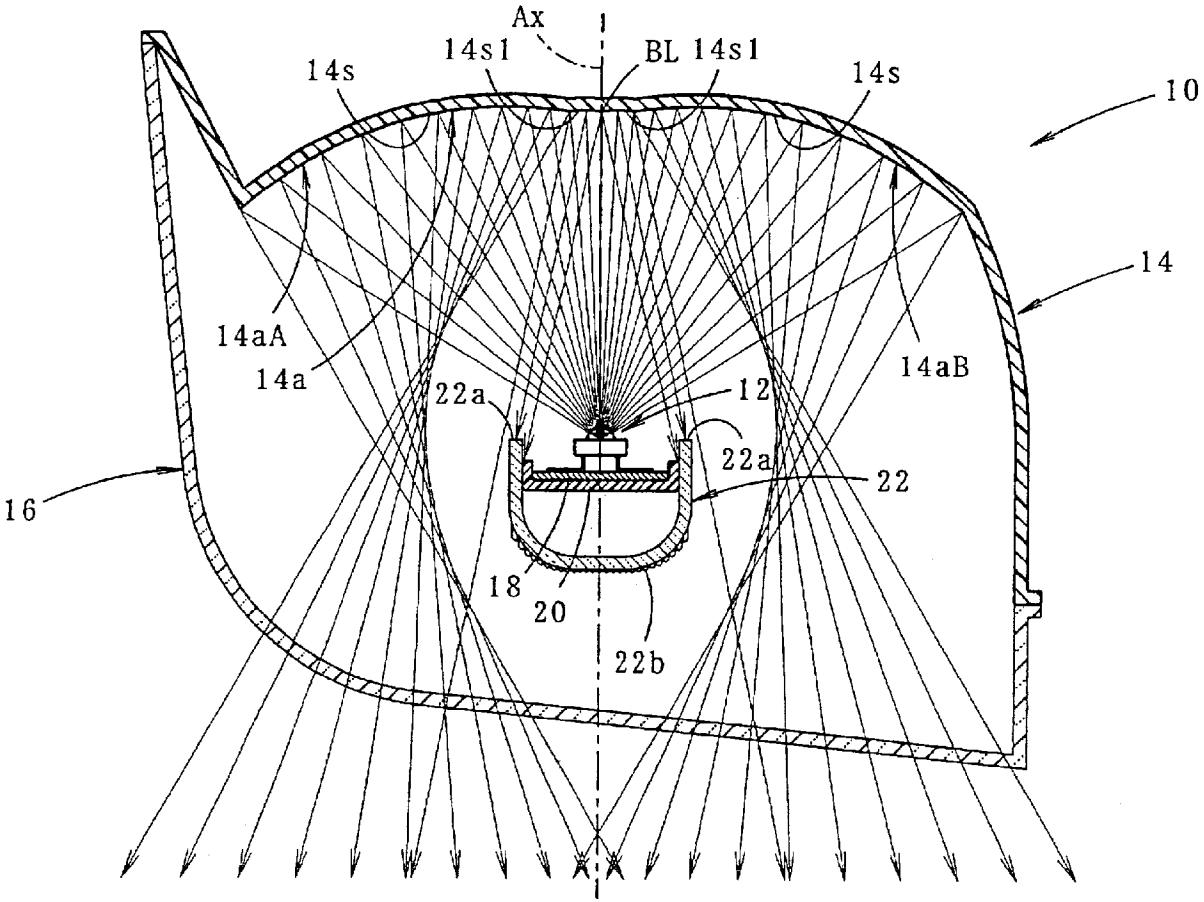
FIG. 2 is a sectional view taken along a line II—II in FIG. 1.
Figure 3:
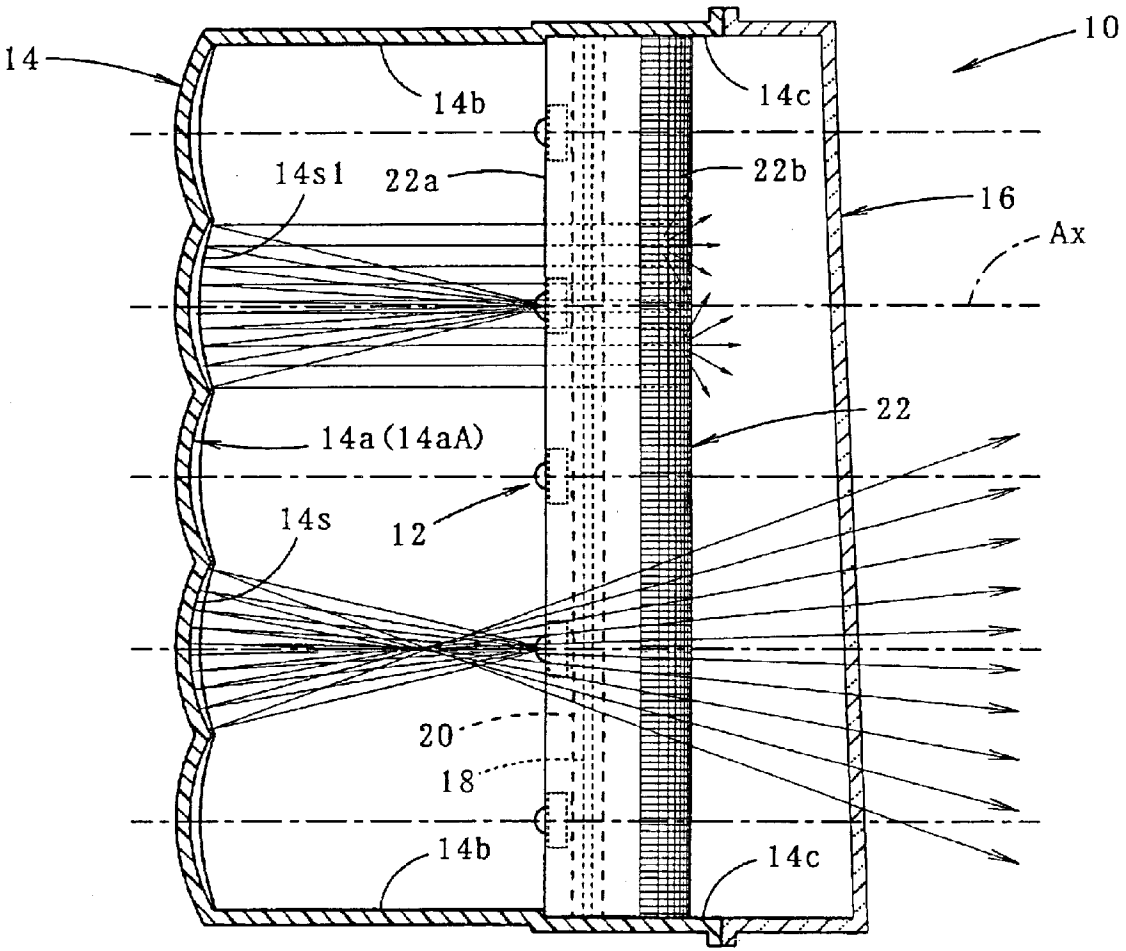
FIG. 3 is a sectional view taken along a line III—III in FIG. 1.

FIG. 1 is a front view of a vehicular lamp constructed according to the first preferred embodiment, and FIGS. 2 and 3 are sectional views of FIG. 1 taken along line II—II and line III—III, respectively.

As shown in these drawings, the vehicular lamp 10 according to the first embodiment is constituted as a tail lamp designed to be mounted at the left rear end portion of an automotive vehicle. A tail lamp mounted at the right rear end portion of the vehicle is structured symmetrically respect to the tail lamp described herein.

This vehicular lamp 10 includes a plurality of LED light sources 12, a reflector 14 for reflecting light from the LED light sources 12 toward the front of the lamp (that is, in the rearward direction of the vehicle), and a red translucent cover 16 mounted on the front side of the reflector 14. The reflector 14 and the translucent cover 16 together define a lamp chamber.

Figure 4:
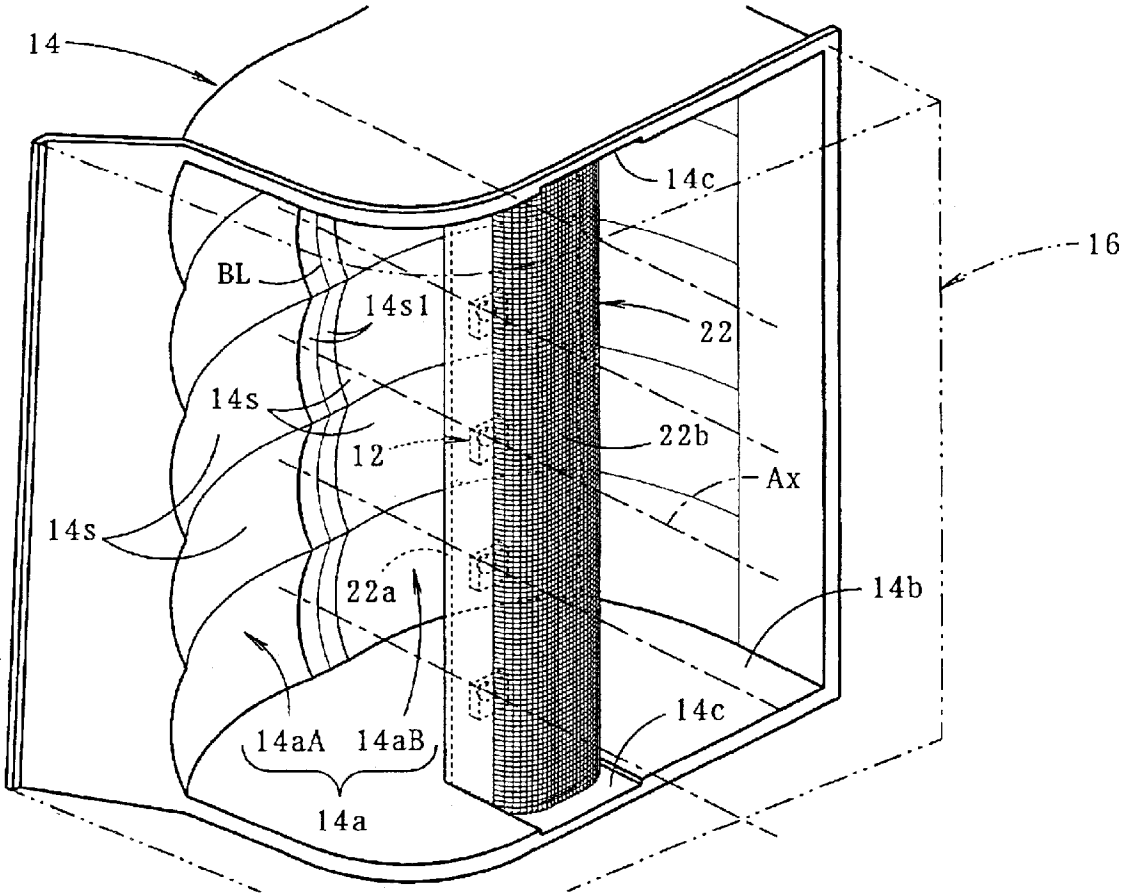
FIG. 4 is a perspective view of the vehicular lamp of FIG. 1 in a state where a translucent cover is removed therefrom.

FIG. 4 is a perspective view of the vehicular lamp 10 with the translucent cover 16 removed therefrom.

As shown in FIG. 4, the LED light sources 12 are arranged in a line at even intervals in the vertical direction with their output light beams directed generally toward the rear of the lamp. The LED light sources12 are mounted on and supported by a circuit board 18 which extends in the vertical direction. The circuit board 18 is fixed to a circuit board holding member 20.

A cover member 22 for covering the circuit board holding member 20 is mounted on the lamp front side of the circuit board holding member 20. The cover member 22 is constituted by a translucent member having a substantially U-shaped horizontal section, and is mounted with both end faces 22*a* thereof directed toward the rear of the lamp. A textured portion 22*b* is formed across the entire front surface of the cover member 22. The circuit board holding member 20 and the cover member 22 are fixed and supported at both upper and lower ends by a positioning concave portion 14*c* formed on both upper and lower wall faces 14*b* of the reflector 14.

The reflecting surface 14*a* of the reflector 14 is divided into two reflecting areas 14*a*A and 14*a*B by a boundary line BL which extends in the vertical direction. The boundary line BL is located directly behind the vertical line which connects the LED light sources 12 so as to bisect the output beam of each LED light source 12. The two reflecting areas 14*a*A and 14*a*B are symmetrical with respect to the boundary line BL. Each reflecting area 14*a*A and 14*a*B is divided into a plurality of small reflecting surfaces 14*s* for each LED light source 12 using as a reference an optical axis Ax extending in the longitudinal direction and passing through the respective LED light source 12.

Each of the plurality of small reflecting surfaces 14*s* has the same structure. That is, the outer shape of each small reflecting surface 14*s* is substantially rectangular with the horizontal side being longer than the vertical side when observed from the front of the lamp. The surface shape of each small reflecting surface 14*s* is concave with a greater curvature than a paraboloid of revolution having the corresponding optical axis Ax as its central axis and the position of the corresponding LED light source 12 as its focus. As a result, the light from each LED light source 12 is reflected in such a manner that it is first converged in the vertical and horizontal directions and then diffused.

The small reflecting surfaces 14*s*, which together constitute the reflecting areas 14*a*A and 14*a*B, include right and left paired elongated reflecting areas 14*s*1 of a rectangular shape in which the vertical side is longer than the horizontal side. The elongated reflecting areas 14*s*1 are in contact with the boundary line BL, with one being located on each side thereof. The elongated reflecting areas 14s1 provide for enhanced light entry to the cover member. The surface shape of these small reflecting areas 14s1 is designed to reflect light from the respective LED light sources 12 toward the two end faces 22a of the cover member 22. Specifically, each small reflecting area 14s1 is formed so as to direct light from the corresponding LED light source 12 toward the two end faces 22a of the cover member 22 as substantially parallel rays without diffusing the light in the vertical and horizontal directions.

Next, the effects of the vehicular lamp of this embodiment of the invention will be explained.

A vehicular lamp 10 according to the present invention is configured so as to reflect the light from a plurality of LED light sources 12 toward the front of the lamp with a specially designed reflector. In this lamp 10, the LED light sources 12 are arranged in a line and arranged so as to direct the light emitted by the LED light sources 12 toward the rear of the lamp. In addition, the reflecting surface 14a of the reflector 14 is divided into two reflecting areas 14aA and 14aB by a boundary line BL which is generally parallel to the arrangement direction of the plurality of LED light sources 12. As a result, a large portion of the light from each the LED light sources 12 reaches the reflecting surface 14a of the reflector 14 and thus forms part of the total light reflected by the reflector.

Moreover, since each reflecting area 14aA and 14aB is divided into a plurality of small reflecting surfaces 14s corresponding to each of the LED light sources 12, it is possible to appropriately control the light from each LED light source 12 by reflecting the light with the small reflecting surface 14s provided on both sides of the light sources, thus ensuring that a large part of the total light output from the LED light sources 12 is directed toward the front of the lamp. Further, since each of the reflecting areas 14aA and 14aB is divided into the plurality of small reflecting surfaces 14s, two for each of the LED light sources 12, when the lamp is observed from the front the number of illuminated areas is twice the number of LED light sources.

Therefore, according to the embodiment described above, the total amount of light emitted in the forward direction of the lamp is increased by effectively using the light output from the LED light sources 12. As a result, the appearance of the lamp is improved.

In this embodiment, the position of the boundary line BL on the reflecting surface 14a is set so as to bisect the output light beam of each LED light source 12. As a result, the reflecting areas 14aA and 14aB on the two sides of the boundary line BL are illuminated with equal luminosity.

Further, each of the small reflecting surfaces 14s which together constitute the reflecting areas 14aA and 14aB is shaped so as to first converge the light from the respective LED light source 12 in the vertical and the horizontal directions and then diffuse it. This arrangement is effective to prevent the reflected light from the small reflecting surfaces 14s from being directed toward the circuit board 18 or the circuit board holding member 20, thus preventing loss of the reflected light.

Moreover, in the vehicular lamp 10 according to this embodiment, the cover member 22 for covering the circuit board holding member 20 is mounted in front of the circuit board holding member 20 which supports the plurality of LED light sources 12 via the circuit board 18. The cover member 22 is constituted by a translucent member having a substantially U-shaped section, and is disposed with the two end faces 22a thereof directed toward the rear of the lamp. As a result, a part of the light reflected by the reflector enters the interior of the cover member 22 from the two end faces 22a and is guided to the front portion thereof. As a result, the cover member 22 is illuminated.

Figure 5:
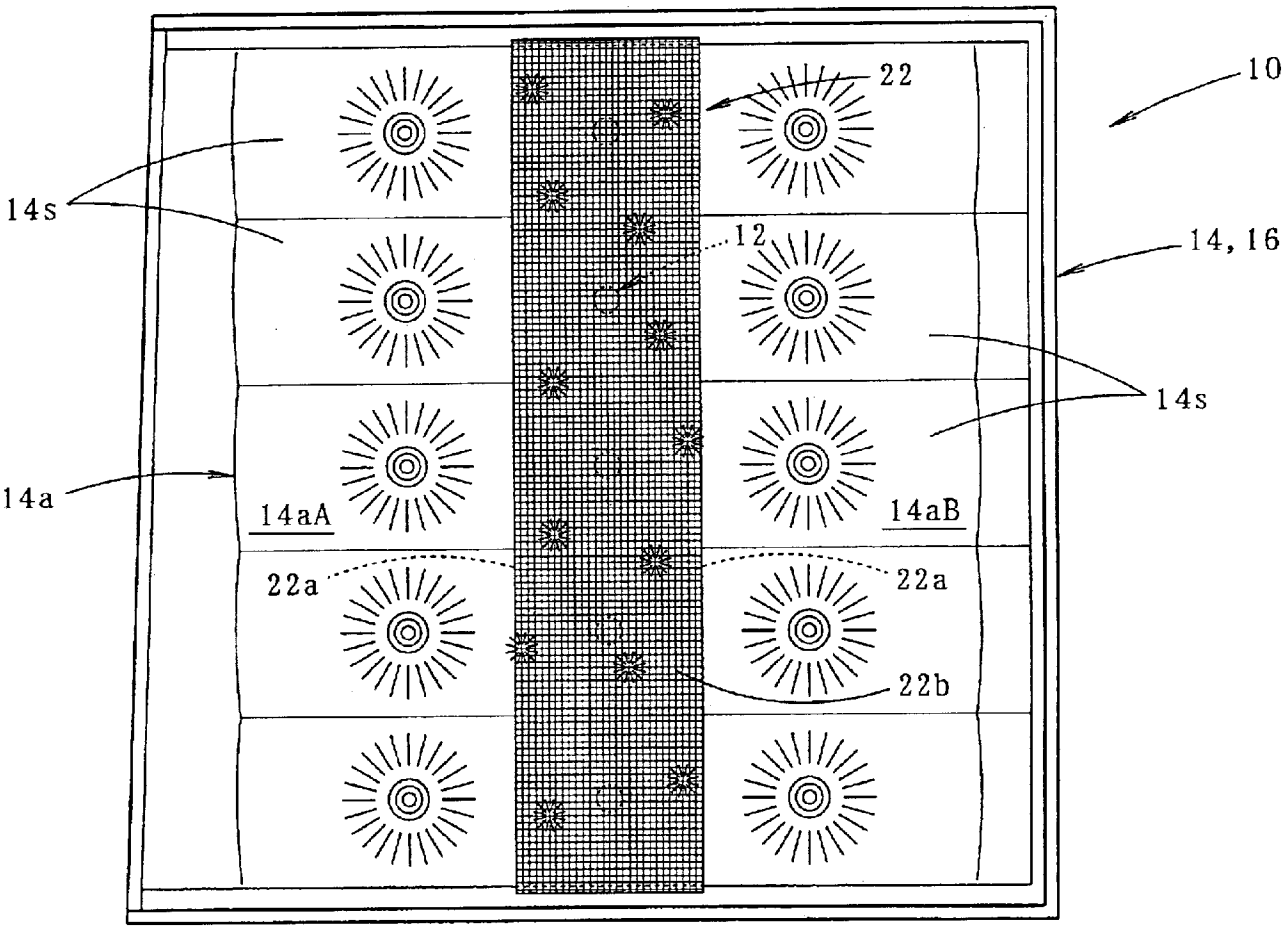
FIG. 5 is a front view showing the appearance of the vehicular lamp of FIG. 1 when lit.

Therefore, as shown in FIG. 5, when the lit vehicular lamp 10 is observed from the front of the lamp, a plurality of pairs of small reflecting surfaces 14s which together constitute the reflecting surface 14a of the reflector 14 are observed as being illuminated on both sides of the cover member 22. Moreover, the cover member 22 is illuminated at a position offset from the small reflecting surface 14a in the direction toward the lamp front side, giving the lamp a three-dimensional appearance.

Also in this embodiment in which the textured portion 22b is provided on the surface of the front end portion of the cover member 22, the light which is guided to the front end portion of the cover member 22 is emitted from the textured portion 22b toward the lamp front side, thus brightly illuminating the cover member 22 over the front end portion thereof.

Further in this embodiment, a predetermined range in the vicinity of the boundary line BL of each small reflecting surface 14s is constituted as the elongated reflecting surfaces 14s1 for facilitating light entry to the cover member by reflecting light from the corresponding LED light source 12 toward the two end faces 22a of the cover member 22. As a result, the amount of the light entering the cover member 22 is increased, thus illuminating the cover member 22 brightly.

Next, a modification of the vehicular lamp 10 of the above-described embodiment will be explained.

Figure 6:
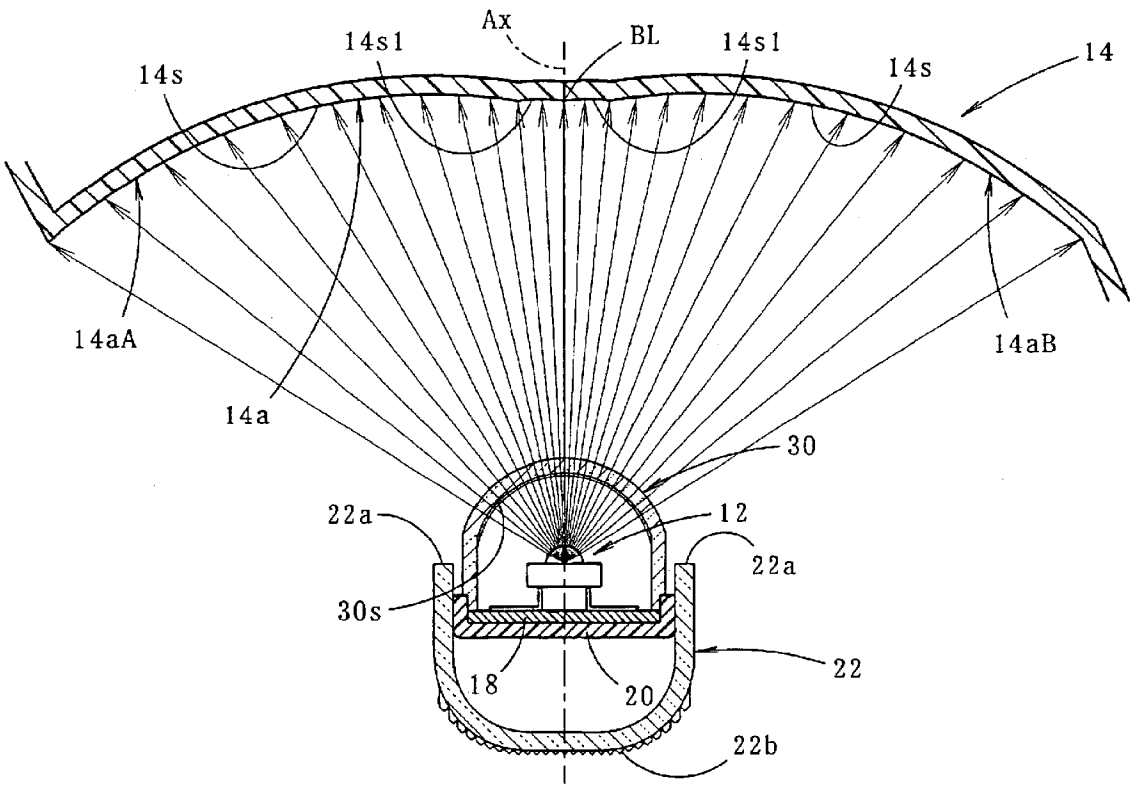
FIG. 6 is a horizontal sectional view of a main portion showing a first modification of the vehicular lamp.
Figure 7:
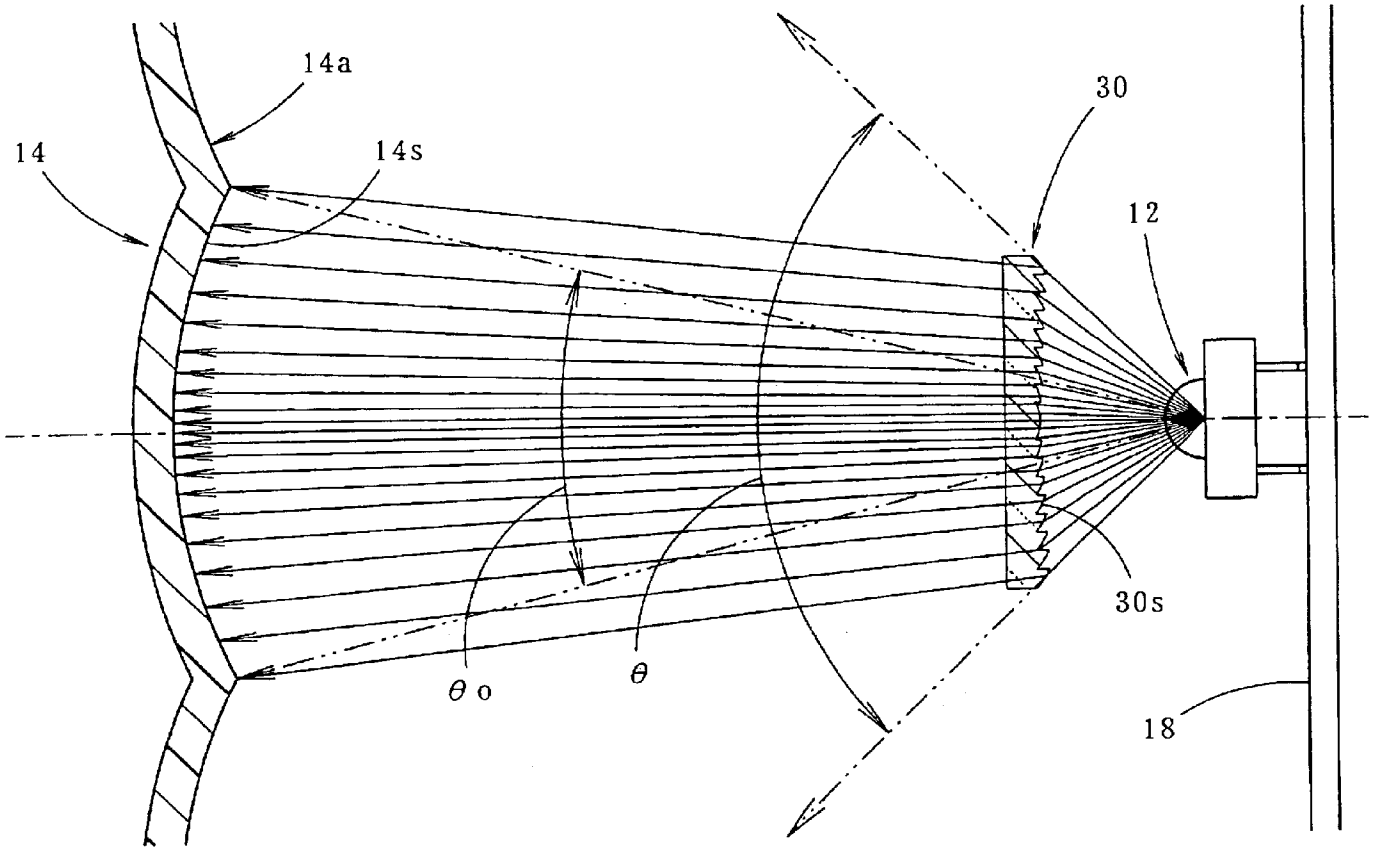
FIG. 7 is a side sectional view of a main portion showing the first modification.
Figure 8:
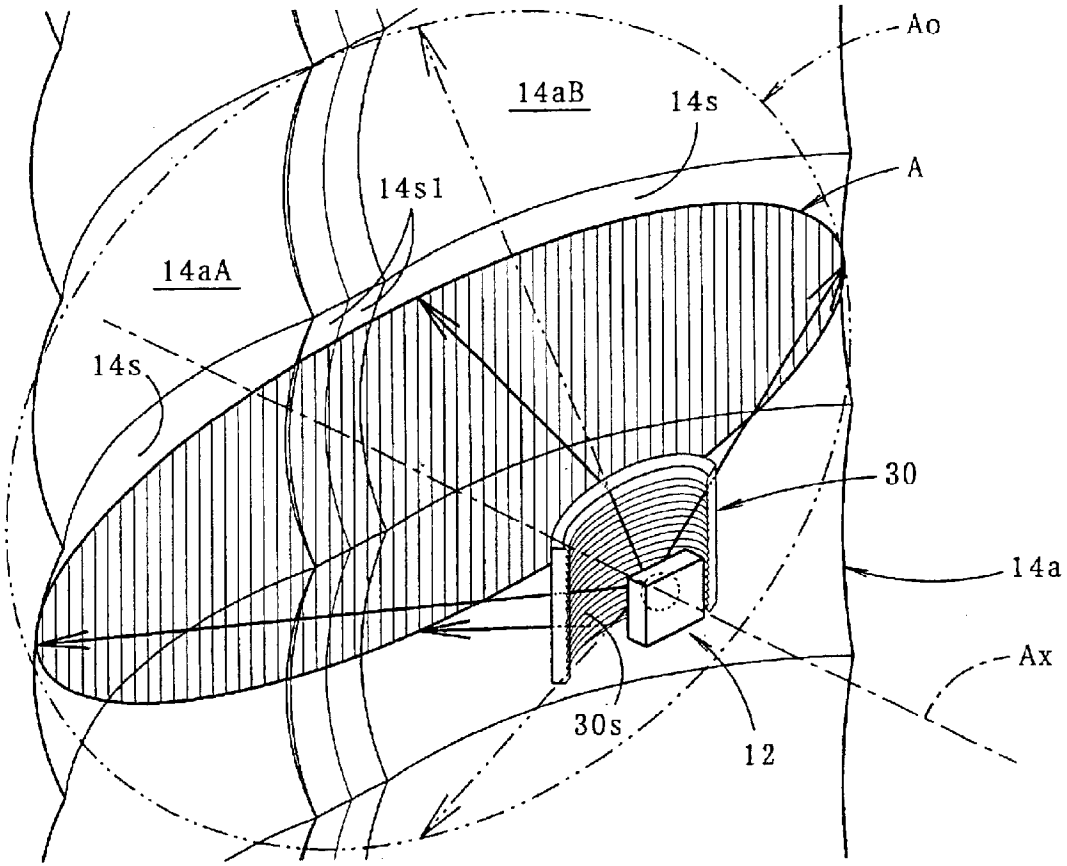
FIG. 8 is a perspective view of a main portion showing the first modification.

FIGS. 6 to 8 are, respectively, a horizontal sectional view of a main portion, a side sectional view of the main portion, and a perspective view of the main portion of a first modification of the vehicular lamp 10 of the above-described preferred embodiment.

As shown in these drawings, in this modification a cylindrical lens 30 is provided for condensing the light from each of the LED light sources 12 in the vertical direction (the direction parallel to the boundary line BL). The cylindrical lens 30, which is mounted to the rear of the LED light source 12, has a Fresnel cylindrical lens portion 30s which has a Fresnel lensing in vertical cross section and a circular configuration in horizontal cross section. The cylindrical lens 30 is supported by the circuit board holding member 20 at both the right and left ends thereof.

The cylindrical lens 30 directs the light from the LED light sources 12 to strike the right and left paired small reflecting surfaces 14s which correspond to the LED light source 12 so as to further reduce the amount of lost light.

That is, as shown in FIG. 7 in vertical cross section including the optical axis Ax, without the cylindrical lens 30 only light within a central angle $\theta_o$ of the full beam angle $\theta$ of the light emitted by the LED light source 12 can reach the right and left paired small reflecting surfaces 14s. In contrast, the entire light output of the LED light source 12 is confined within the angle $\theta_o$ when the cylindrical lens 30 is provided, and hence all of the light emitted by the LED light source 12 reaches the right and left paired small reflecting surfaces 14s. As shown in FIG. 8, light which is emitted within a circular range $A_o$, around the optical axis Ax as a center is compressed into a transverse elliptic circular range A before striking the right and left paired small reflecting surfaces 14s. Therefore, the light from each LED light source 12 is used efficiently.

In this modification, since a lens having a Fresnel cylindrical lens portion 30a having Fresnel lensing in vertical cross section is employed for the cylindrical lens 30, the lens can be produced with a substantially uniform thickness. Therefore, if the cylindrical lens 30 is produced by injection molding from a synthetic resin, it is possible to inhibit the occurrence of the shrinkage, thus ensuring good lens accuracy.

It should be noted that, in an alternate arrangement, it is also possible to form the vertical cross section in a simple circular shape or the like.

Figure 9:
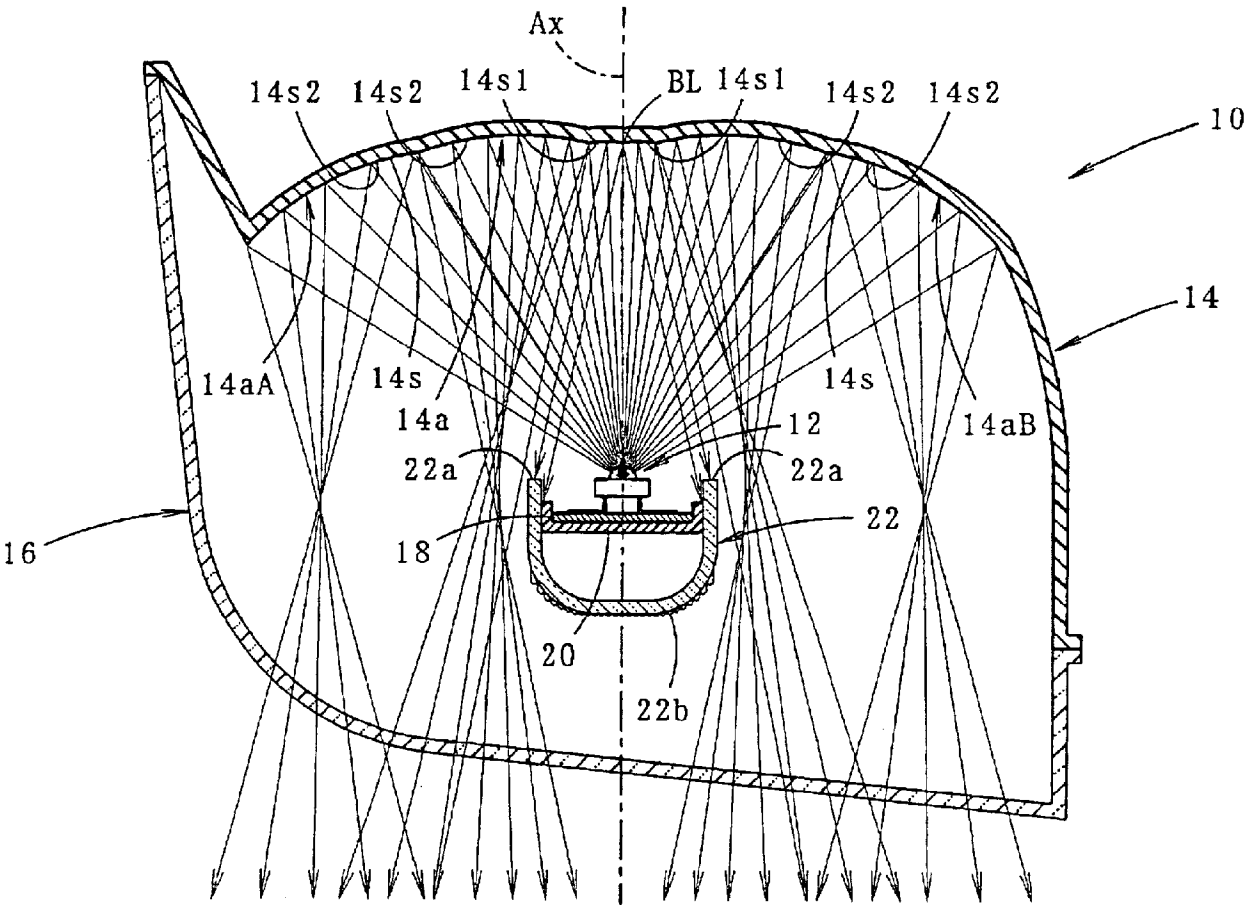
FIG. 9 is similar to FIG. 2 showing a second modification of the vehicular lamp.
Figure 10:
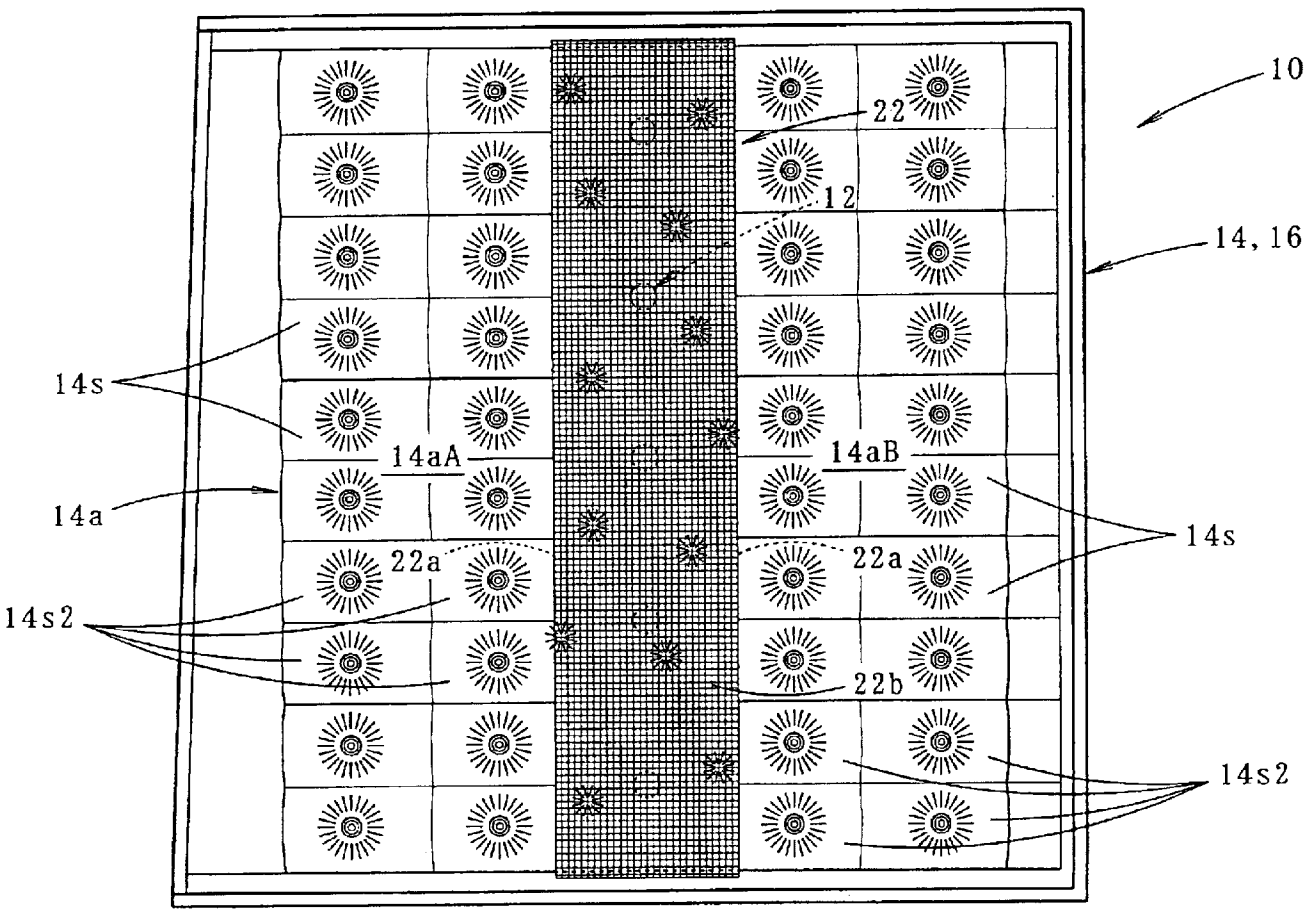
FIG. 10 is similar to FIG. 5 showing the second modification of the vehicular lamp.

FIGS. 9 and 10, which are views similar to FIGS. 2 and 5, show a second modification of the vehicular lamp 10.

As shown in FIGS. 9 and 10, in this modification each small reflecting surface 14*s* is constituted by a plurality of smaller reflecting elements 14*s*2. The reflecting elements 14*s*2 have a concave curved surface which has a greater curvature than a paraboloid of revolution having the optical axis Ax as its center axis and the position of the corresponding LED light source 12 as its focus. As a result, the light from each LED light source 12 is reflected in such a manner that it is first converged in the vertical and horizontal directions and then diffused.

In the lamp configured as described above, as shown in FIG. 10, when the lit vehicular lamp 10 is observed from a position in front of the lamp, since each small reflecting surface 14*s* appears to be lit at a plurality (four) of locations for each reflecting element 14*s*2 the appearance of the lamp is further improved.

In the preferred embodiment and each modification described above, a lamp chamber is constituted by the reflector 14 and the translucent cover 16. However, it is also possible to employ a lamp structure in which a reflector is provided in a lamp chamber constituted by a lamp body and a translucent cover. In this case as well the same effects as those described above can be obtained.

In addition, in the preferred embodiment and each modification described above, an example in which the vehicular lamp 10 is embodied as a tail lamp has been explained. However, the same effects can be obtained with other types of vehicular lamps such as a stop lamp, a clearance lamp, or the like by employing the same structure as that of the preferred embodiment and the modifications described above.

It should further be apparent to those skilled in the art that various changes in form and detail of the invention as shown and described above may be made. It is intended that such changes be included within the spirit and scope of the claims appended hereto.

What is claimed is:

1. A vehicular lamp comprising: a plurality of LED light sources, a reflector for reflecting light from said LED light sources toward the front of the lamp, and a translucent cover provided at a front side of said reflector, the plurality of LED light sources being arranged in a line and mounted such that their respective light output beams are directed toward said reflector, a reflecting surface of said reflector being divided into two reflecting areas by a boundary line extending substantially parallel to said line along which said plurality of the LED light sources are arranged, and each of said reflecting areas being divided, substantially transversely to the boundary line, into a plurality of small reflecting surfaces, two of said small reflecting surfaces being provided for each of said LED light sources.

2. The vehicular lamp according to claim 1, wherein said boundary line bisects an illumination angle of each of said LED light sources.

3. The vehicular lamp according to claim 1, wherein said line along which said plurality of LED light sources are arranged is substantially straight.

4. The vehicular lamp according to claim 1, wherein each of said small reflecting surfaces has a concave surface shape having a greater curvature than a paraboloid of revolution having the optical axis of the corresponding small reflecting surface as its central axis and the position of the corresponding LED light source as its focus.

5. The vehicular lamp according to claim 1, further comprising a cover member for covering said LED light sources, said cover member being provided at a front side of said plurality of LED light sources, said cover member comprising a translucent member having a substantially U-shaped horizontal section perpendicular to said boundary line, and said cover member being disposed with end faces of said cover member being directed toward the rear of said lamp.

6. The vehicular lamp according to claim 5, wherein said reflector comprises, for each of said LED light sources, a pair of elongated reflecting surfaces formed on said reflecting surface on opposite sides of said boundary line for reflecting light from the corresponding LED light source toward respective ones of said end faces of said cover member.

7. The vehicular lamp according to claim 6, wherein said elongated reflecting surfaces reflect light without substantial diffusion in horizontal and vertical directions.

8. The vehicular lamp according to claim 1, wherein said reflecting surfaces are substantially equal in size.

9. The vehicular lamp according to claim 1, wherein said small reflecting surfaces are substantially rectangular in configuration and have a long side extending in a horizontal direction.

10. The vehicular lamp according to claim 1, further comprising a cylindrical lens provided at a rear side of each of said LED light sources for condensing light from the corresponding LED light source.

11. The vehicular lamp according to claim 10, wherein said cylindrical lens has Fresnel lensing in vertical cross section and a circular configuration in horizontal cross section.

12. A vehicular lamp comprising: a plurality of LED light sources, a reflector for reflecting light from said LED light sources toward the front of the lamp, and a translucent cover provided at a front side of said reflector, the plurality of LED light sources being arranged in a line and mounted such that their respective light output beams are directed toward said reflector, a reflecting surface of said reflector being divided into two reflecting areas by a boundary line extending substantially parallel to said line along which said plurality of the LED light sources are arranged, each of said reflecting areas being divided into a plurality of small reflecting surfaces, and each of said small reflecting surfaces being divided into a plurality of smaller reflecting elements.

13. The vehicular lamp according to claim 12, wherein said boundary line bisects an illumination angle of each of said LED light sources.

14. The vehicular lamp according to claim 12, wherein said line along which said plurality of LED light sources are arranged is substantially straight.

15. The vehicular lamp according to claim 12, wherein each of said smaller reflecting elements has a concave surface shape having a greater curvature than a paraboloid of revolution having the optical axis of the corresponding small reflecting surface as its central axis and the position of the corresponding LED light source as its focus.

16. The vehicular lamp according to claim 12, further comprising a cover member for covering said LED light sources, said cover member being provided at a front side of said plurality of LED light sources, said cover member comprising a translucent member having a substantially U-shaped horizontal section perpendicular to said boundary line, and said cover member being disposed with end faces of said cover member being directed toward the rear of said lamp.

17. The vehicular lamp according to claim 12, wherein said reflecting surfaces are substantially equal in size.

18. The vehicular lamp according to claim 12, wherein said small reflecting surfaces are substantially rectangular in configuration and have a long side extending in a horizontal direction.

19. The vehicular lamp according to claim 12, further comprising a cylindrical lens provided at a rear side of each of said LED light sources for condensing light from the corresponding LED light source.

20. A vehicular lamp comprising: a plurality of LED light sources, a reflector for reflecting light from said LED light sources toward the front of the lamp, and a translucent cover provided at a front side of said reflector, the plurality of LED light sources being arranged in a line and mounted such that their respective light output beams are directed toward said reflector, a reflecting surface of said reflector being divided into two reflecting areas by a boundary line extending substantially parallel to said line along which said plurality of the LED light sources are arranged, and each of said reflecting areas being divided into a plurality of small reflecting surfaces, two of said small reflecting surfaces being provided for each of said LED light sources, wherein each of said small reflecting surfaces has a concave surface shape having a greater curvature than a paraboloid of revolution having the optical axis of the corresponding small reflecting surface as its central axis and the position of the corresponding LED light source as its focus.

21. A vehicular lamp comprising: a plurality of LED light sources, a reflector for reflecting light from said LED light sources toward the front of the lamp, and a translucent cover provided at a front side of said reflector, the plurality of LED light sources being arranged in a line and mounted such that their respective light output beams are directed toward said reflector, a reflecting surface of said reflector being divided into two reflecting areas by a boundary line extending substantially parallel to said line along which said plurality of the LED light sources are arranged, and each of said reflecting areas being divided into a plurality of small reflecting surfaces, two of said small reflecting surfaces being provided for each of said LED light sources, said lamp further comprising a cover member for covering said LED light sources, said cover member being provided at a front side of said plurality of LED light sources, said cover member comprising a translucent member having a substantially U-shaped horizontal section perpendicular to said boundary line, and said cover member being disposed with end faces of said cover member being directed toward the rear of said lamp.

22. The vehicular lamp according to claim 21, wherein said reflector comprises, for each of said LED light sources, a pair of elongated reflecting surfaces formed on said reflecting surface on opposite sides of said boundary line for reflecting light from the corresponding LED light source toward respective ones of said end faces of said cover member.

23. The vehicular lamp according to claim 22, wherein said elongated reflecting surfaces reflect light without substantial diffusion in horizontal and vertical directions.

24. A vehicular lamp comprising: a plurality of LED light sources, a reflector for reflecting light from said LED light sources toward the front of the lamp, and a translucent cover provided at a front side of said reflector, the plurality of LED light sources being arranged in a line and mounted such that their respective light output beams are directed toward said reflector, a reflecting surface of said reflector being divided into two reflecting areas by a boundary line extending substantially parallel to said line along which said plurality of the LED light sources are arranged, and each of said reflecting areas being divided into a plurality of small reflecting surfaces, two of said small reflecting surfaces being provided for each of said LED light sources, said lamp further comprising a cylindrical lens provided at a rear side of each of said LED light sources for condensing light from the corresponding LED light source.

25. The vehicular lamp according to claim 24, wherein said cylindrical lens has Fresnel lensing in vertical cross section and a circular configuration in horizontal cross section.

26. The vehicular lamp according to claim 12, wherein each of said reflecting areas are divided, substantially transversely to the boundary line, into the plurality of small reflecting surfaces.

27. A vehicular lamp comprising: a plurality of LED light sources, a reflector for reflecting light from said LED light sources toward the front of the lamp, and a translucent cover provided at a front side of said reflector, the plurality of LED light sources being arranged in a line and mounted such that their respective light output beams are directed toward said reflector, a reflecting surface of said reflector being divided into two reflecting areas by a boundary line extending substantially parallel to said line along which said plurality of the LED light sources are arranged, and each of said reflecting areas being divided into a plurality of small reflecting surfaces, two of said small reflecting surfaces being provided for each of said LED light sources, wherein the light reflected by the reflector passes along both sides of the plurality of LED light sources being arranged in a line.

* * * * *